US009737774B1

(12) United States Patent
Riley et al.

(10) Patent No.: US 9,737,774 B1
(45) Date of Patent: Aug. 22, 2017

(54) GOLF TEE DISPENSER

(71) Applicants: James Joseph Riley, Tucson, AZ (US); Gregory Alan Stanley, Tucson, AZ (US)

(72) Inventors: James Joseph Riley, Tucson, AZ (US); Gregory Alan Stanley, Tucson, AZ (US)

( * ) Notice: Subject to any disclaimer, the term of this patent is extended or adjusted under 35 U.S.C. 154(b) by 0 days.

(21) Appl. No.: 14/859,259

(22) Filed: Sep. 19, 2015

Related U.S. Application Data

(60) Provisional application No. 62/055,898, filed on Sep. 26, 2014.

(51) Int. Cl.
*B65D 83/02* (2006.01)
*A63B 57/20* (2015.01)
*B65D 47/06* (2006.01)

(52) U.S. Cl.
CPC ..... *A63B 57/203* (2015.10); *B65D 47/06* (2013.01); *B65D 83/02* (2013.01)

(58) Field of Classification Search
None
See application file for complete search history.

(56) References Cited

U.S. PATENT DOCUMENTS 389,547 A * 1/1898 Smallwood et al. .... D05B 3/06 D21/234
2,793,862 A 5/1957 O'Brien
3,251,615 A 5/1966 Hill et al.
3,891,130 A 6/1975 Brennan
3,892,334 A 7/1975 Hand et al.
4,180,160 A * 12/1979 Ogawa ..... A47K 10/3818 206/210
4,573,610 A 3/1986 Hurner
4,858,784 A 8/1989 Moody
4,889,260 A 12/1989 Zeller
5,040,675 A * 8/1991 Cleveland ..... A63B 47/00 206/315.9
5,056,697 A 10/1991 Sheffield
5,775,538 A * 7/1998 Covington ..... A63B 57/203 221/307
2009/0178942 A1 7/2009 Balazs
2011/0253736 A1 * 10/2011 Fujimoto ..... G01N 33/48778 221/199

* cited by examiner

*Primary Examiner* — Timothy Waggoner
*Assistant Examiner* — Ayodeji Ojofeitimi
(74) *Attorney, Agent, or Firm* — Invention To Patent Services; Alex Hobson

(57) ABSTRACT

A golf tee dispenser is configured to provide a single tee for retrieval when the golf tee dispenser is agitated. A golf tee dispenser has a deflector to deflect a plurality of tees away from a tee-opening to increase the effectiveness of the tees being extended through the tee opening upon agitation. A golf tee dispenser also has a resilient retainer that is configured to retain a tee by a tee-head until the tee is pulled from the tee dispenser. A resilient retainer is configured to deform or deflect to allow the tee head to pass through the resilient retainer and then return substantially to a pre deformed state. A golf tee dispenser is configured to hold a plurality of tees in a container and a cap is configured to attach to a container opening.

20 Claims, 14 Drawing Sheets

GOLF TEE DISPENSER

CROSS REFERENCE TO RELATED APPLICATION

This application claims the benefit and priority to U.S. provisional patent application No. 62/055,898, filed on Sep. 26, 2014 and entitled Golf Tee Dispenser; the entirety of which is incorporated by reference herein.

BACKGROUND OF THE INVENTION

Field of the Invention

The present invention relates to a golf tee dispenser and particularly to a portable golf tee dispenser that utilizes agitation to automatically extend a single tee partially from the dispenser for retrieval.

Background

Golfers need a convenient way to store a plurality of tees and a dispenser that provides a single tee for retrieval. Some current tee dispensers utilize a bag or a plurality of holes to increase the probability that a tee will extend through one of the openings in the container. Unfortunately, these devices are relatively large to increase the likelihood that a tee will be available to a golfer when needed and do provide a single tee in an efficient manner. These devices may be cumbersome to store as they can have a plurality of tees poking out in various directions. Some of these devices utilize agitation to cause a tee to extend through an opening do not ensure a tee will be available when needed.

SUMMARY OF THE INVENTION

The invention is directed to a golf tee dispenser and particularly to a portable golf tee dispenser that utilizes agitation to automatically extend a single tee for retrieval.

In an exemplary embodiment, a golf tee dispenser comprises a container configured to hold a plurality of golf tees and a cap configured to detachably attach to said container over a container opening. The golf tee dispenser utilizes a deflector to deflect some of the tees away from a resilient retainer opening. The deflector is configured to more effectively direct a single tee down through the resilient retainer opening and avoid a clogging in the dispenser due to two or more tees competing for extension through the resilient retainer opening.

The container is preferably configured with a width, diameter or maximum cross-length dimension that is less than the length of the tees contained therein. This configuration ensures that the tees remain in a substantially vertical orientation along the length axis of the container. For example, a plurality of golf tees may be inserted into the container with the tip of the tees configured proximal the dispenser end of the container and no matter how much the container is agitated, the tees will remain configured in a substantially vertical orientation along the length axis of the container with the tips of the tees proximal the dispenser opening. A containers maximum cross-length dimension may equal to or less than the length of the tees inserted therein including, but not limited to, no more than about 90% of the tee length, no more than about 75% of the tee length and the like. A container may have a length that is greater than the length of the tees inserted therein and may be at least about 10% longer than the tees inserted therein, at least about 20% longer than the tees inserted therein, at least about 30% longer than the tees inserted therein, at least about 50% longer than the tees inserted therein and any range between and including the length values provided. For example, an exemplary container may have a maximum cross-length dimension of about 4 cm or more, about 6 cm or more, about 8 cm or more, about 10 cm or more and any range between and including the maximum cross-length dimensions provided. An exemplary container may have a length of about 6 cm or more, about 8 cm or more, about 10 cm or more, about 14 cm or more and any range between and including the length values provided. It is to be understood that golf tees come in a variety of lengths and a container configured to accommodate the various tees may be selected as required. An exemplary container may be configured to hold any suitable number of golf tees including, but not limited to, about 10 or more, about 20 or more, about 30 or more, about 50 or more, about 75 or more and any range between and including the number of golf tees provided. A typical round of golf is eighteen holes and in an exemplary embodiment, the golf tee dispenser is configured to hold at least 18 golf tees. In a preferred embodiment, a container is configured to hold no more than about 30 tees, as this size is more than enough tees for a round of 18 holes of golf.

An exemplary container may be at least partially translucent or transparent to enable a user to see how many tees are remaining in the golf tee dispenser. A golfer may choose to refill the golf tee dispenser when a relatively low number of tees are remaining. In addition, any suitable logo, text, or trademark may be printed onto a portion of the golf tee dispenser and particularly the container portion. For example, a golf tee container may be translucent and have a sports team logo and/or team name configured on one or more portions of the container.

A cap may be configured to detachably attach to a container in any suitable way. In one embodiment, a container and cap are configured with threads to enable the cap to be screwed onto the container. In another embodiment, a container is configured with an attachment feature, such as a protrusion or recess that is configured to nest with a cap attachment feature. The cap may be a snap-on cap for example having an outer perimeter that extends over an opening of the container. For example, a container may have a recess and a cap may be configured with a ring shaped protrusion that snaps into the container recess when attached thereto. A cap attachment feature may be a recess or protrusion as well.

An exemplary golf tee dispenser, as described herein, comprises a deflector that is configured to deflect some of the tees away from the tee-opening, thereby avoiding clogging. A deflector may be cone shaped and have an opening that allows a tee to extend through the deflector and into a tee-opening. In an exemplary embodiment, the deflector opening is configured over resilient retainer and in another embodiment, the deflector is made out of a resilient material. In an exemplary embodiment, a deflector is configured with an opening that is higher in position than the outside perimeter of the deflector when configured in the golf tee dispenser. A deflector may be configured to have any suitable deflector angle, or offset angle from perpendicular to the length axis of the container, including, but not limited to about 15 degrees or more, about 25 degrees or more, about 35 degrees or more, about 45 degrees or more, about 60 degrees or more and any range between and including the deflector angles provided.

A deflector may be a detachable component that may be inserted into a cap and then secured to the container when the cap is attached over the container opening. A detachable deflector may be sized to be retained by the cap and/or container when the cap is attached. A deflector may be an integral deflector, or a one-piece unit with the container, the cap, or the resilient retainer. For example, a cap may have deflector that is molded with the cap wherein a resilient retainer may be attached to the cap under the deflector. In another embodiment, a deflector is configured as a one-piece unit with a resilient retainer or the deflector and resilient retainer are a single piece of material. In this embodiment, the resilient retainer has a substantially cone shaped upper surface with an opening in the top of the resilient retainer that is higher than the integral deflector perimeter. In yet another embodiment, a deflector is integral, or a one-piece unit with the container. A deflector may be made out of any suitable material including a plastic, metal, glass, ceramic, composites and the like.

A golf tee dispenser as described herein comprises a resilient retainer having a tee-opening therein. A resilient retainer allows a tee-tip and tee-shaft to pass through the tee-opening and retains the tee-head as the tee-opening in smaller in dimension than the tee-head. A golfer may then pull on the tee-shaft to remove an extended tee from a golf tee dispenser. The resilient retainer comprises a resilient material that enables the tee-head to be pulled through the tee-opening which temporarily deforms the resilient retainer. The resilient retainer is configured to substantially return to an original shape after a tee-head has been pulled through the tee-opening. A resilient retainer may comprise, consist essentially of or consist of an elastomer, rubber, or any other suitable resilient material. In an exemplary embodiment, a resilient retainer consists of an elastomeric material that can readily deform, to allow a tee-head to pass through the tee opening, and then return substantially to a pre-deformed configuration.

A tee-opening in a resilient retainer may have any suitable shape and in an exemplary embodiment is circular but may be oval, square, triangular, rectangular, polygonal, star shaped, irregularly shaped, and the like. A resilient retainer may comprise one or more slits that extend from a tee-opening toward the perimeter of the resilient retainer. These one or more slits may enable a portion of the resilient retainer to deform more easily as the tee-head is pulled through the tee-opening. A portion of resilient retainer material between adjacent slits may form a flap that is configured to deflect outward as the tee is pulled out from the golf tee dispenser.

A resilient retainer may be configured to fit within a cap in such a way to locate the tee-opening over a cap-opening. A resilient retainer may be configured to seat within a recess of a cap or have an outer diameter or dimension that securely locates the resilient retainer within the cap. In another embodiment, a resilient retainer is configured to attach to the cap and may extend around a wall portion of the cap such that a portion of the resilient retainer is within the cap and a portion of the resilient retainer is outside of the cap. In this embodiment, a resilient retainer may have the general shape of a grommet having two enlarged portions connected by a more narrow, or smaller dimensioned, portion. In yet another embodiment, a resilient retainer is attached to a deflector and the deflector is retained within the cap.

A golf tee dispenser may comprise a refill-cap or detachable cover that is configured on the tee-head end of the container, or opposite the tee dispenser end of the container to allow replacement of tees as they are removed. A refill-cap may allow replacement of tees without excessive disturbance of the tees within the dispenser portion.

A golf tee dispenser container, as described herein is a rigid container, that is free standing, or self-supporting, wherein it maintains a shape, such as a plastic or glass bottle or container. The container may be transparent at least over a portion of the container.

A golf tee dispenser, as described herein may comprise a latch or other suitable attachment feature, such as a karabiner to attach the tee dispenser to a golf bag, golf pull cart, or golf cart, for example. An attachment feature may be configured proximal to the top of the golf tee dispenser to allow the tee dispenser to hang in a downward orientation and move freely. Agitation of the golf tee dispenser created as the golf cart, to which the golf tee dispenser is attached to, drives along the golf course will cause a tee to pass through the tee opening and be available for retrieval.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
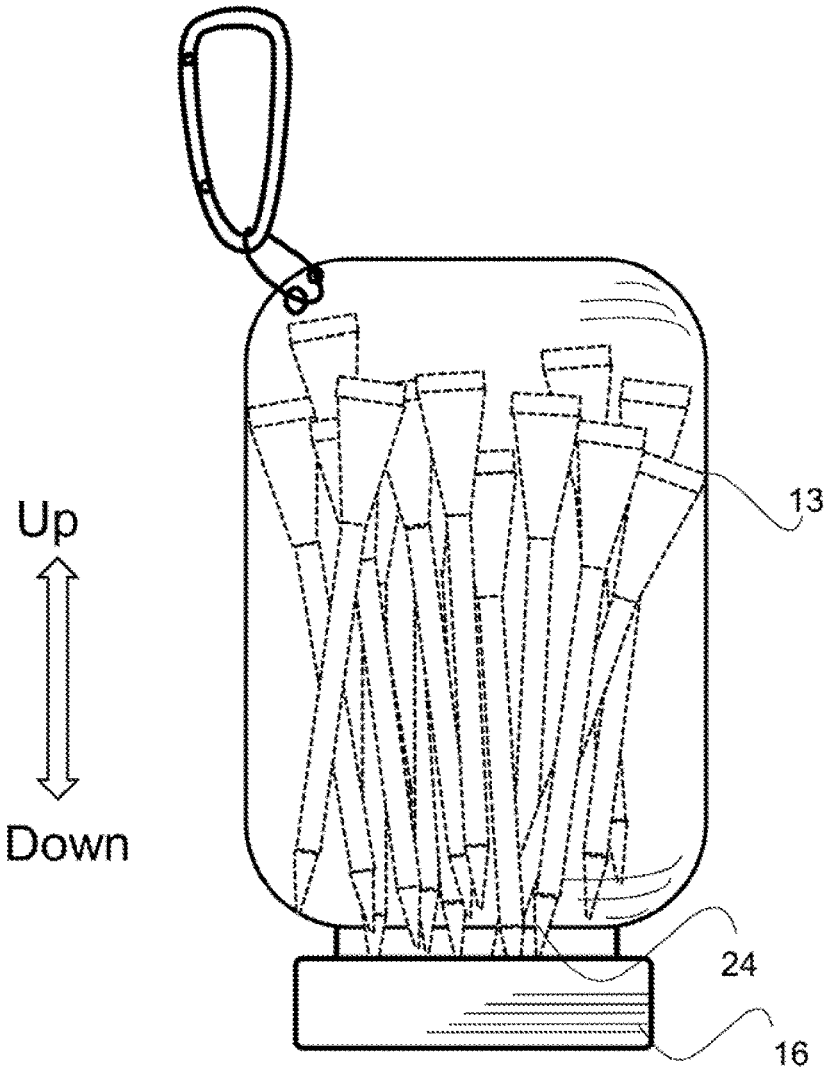

FIG. 1 shows a side view of a golf tee dispenser having no deflector, whereby the tees are jammed upon agitation and prevents a tee from being able to extend through a tee-opening.

Figure 2:
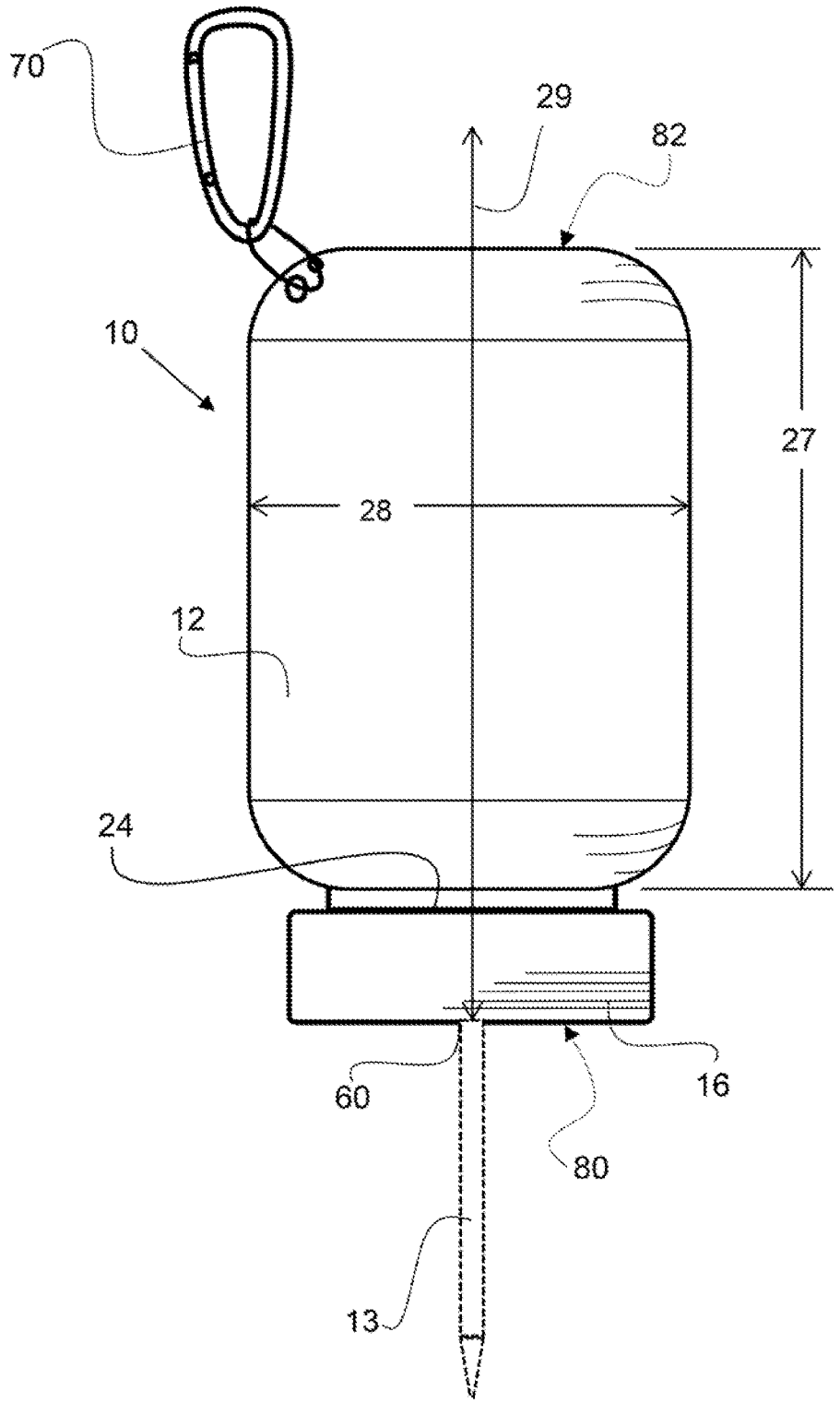

FIG. 2 shows a side view of an exemplary golf tee dispenser having a container for a plurality of tees, a cap over the container opening and a tee extending from the tee-opening.

Figure 3:
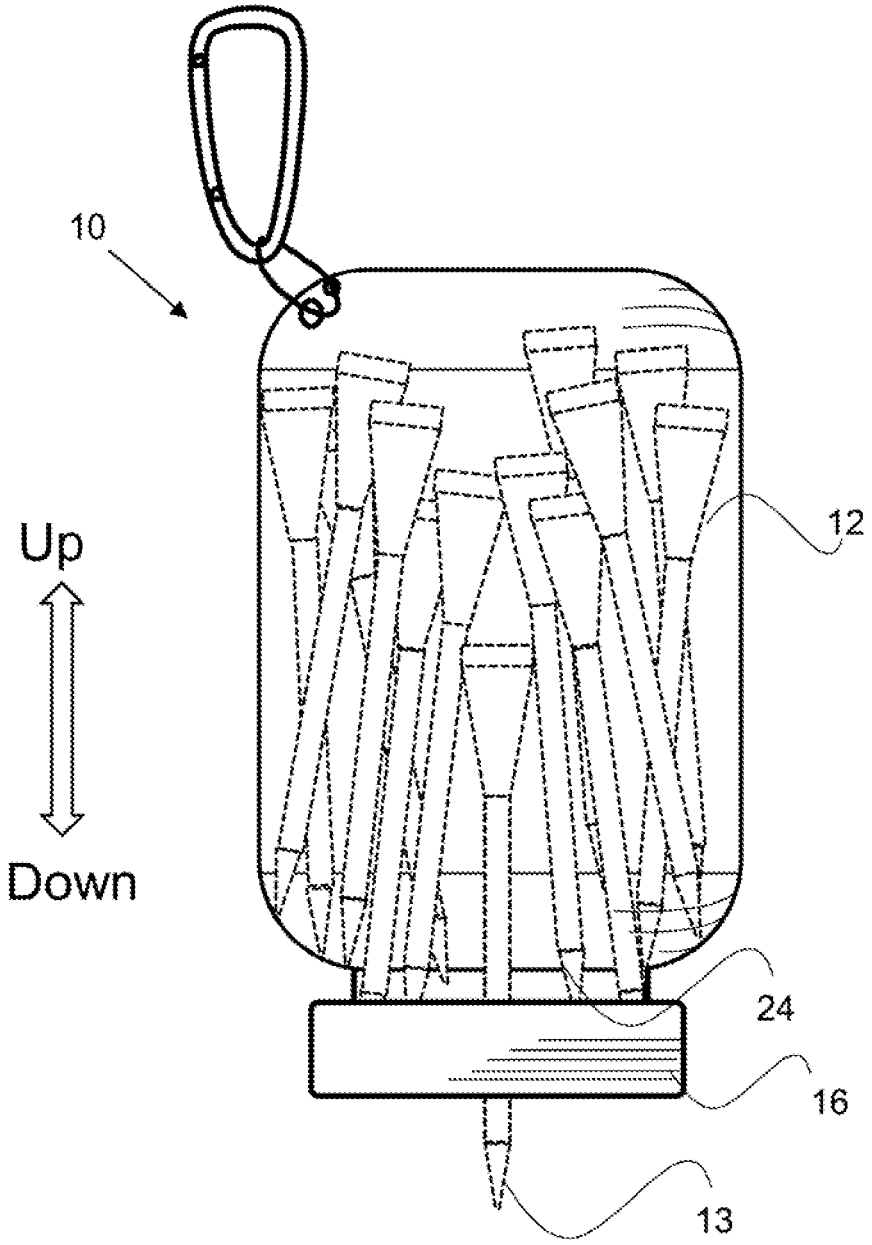

FIG. 3 shows a side view of an exemplary golf tee dispenser having a translucent container and a deflector configured to deflect a plurality of tees away from the tee opening.

Figure 4:
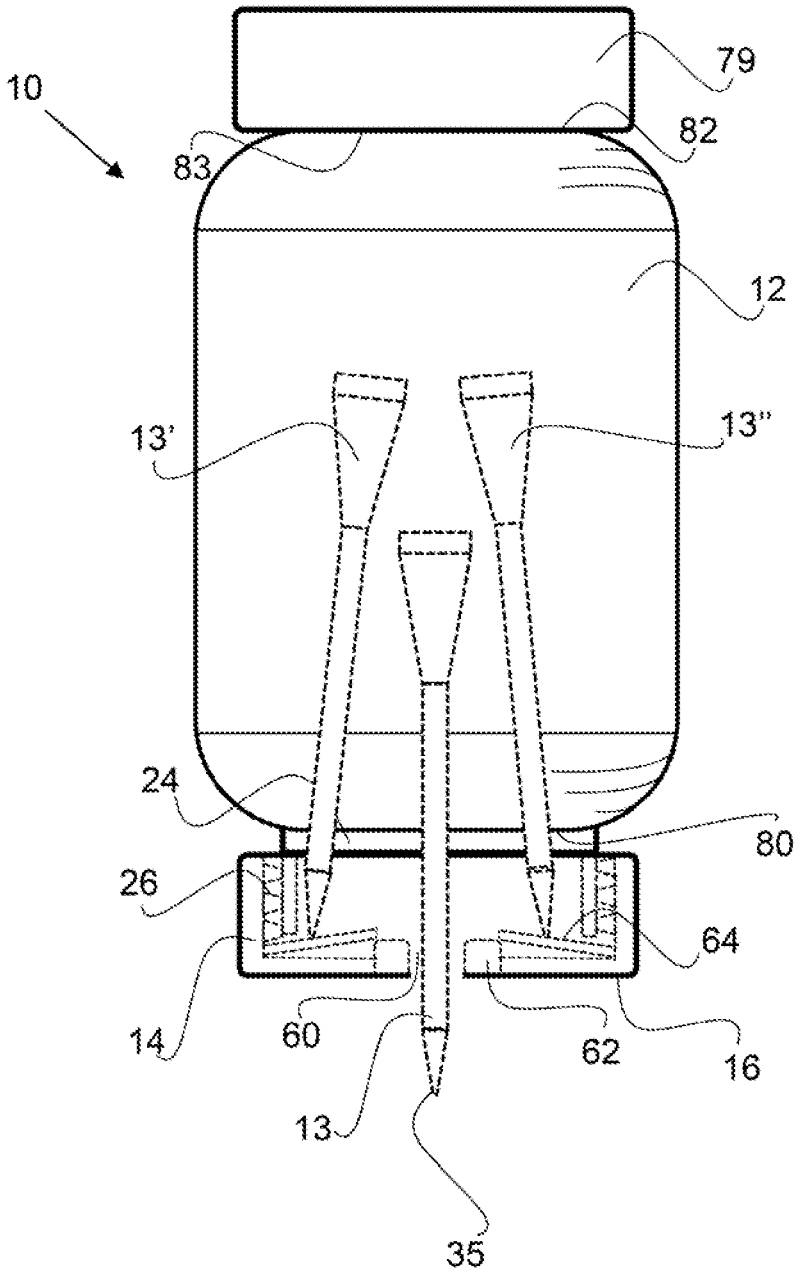

FIG. 4 shows a side cut-away view of an exemplary golf tee dispenser having a cap attached to a container.

Figure 5:
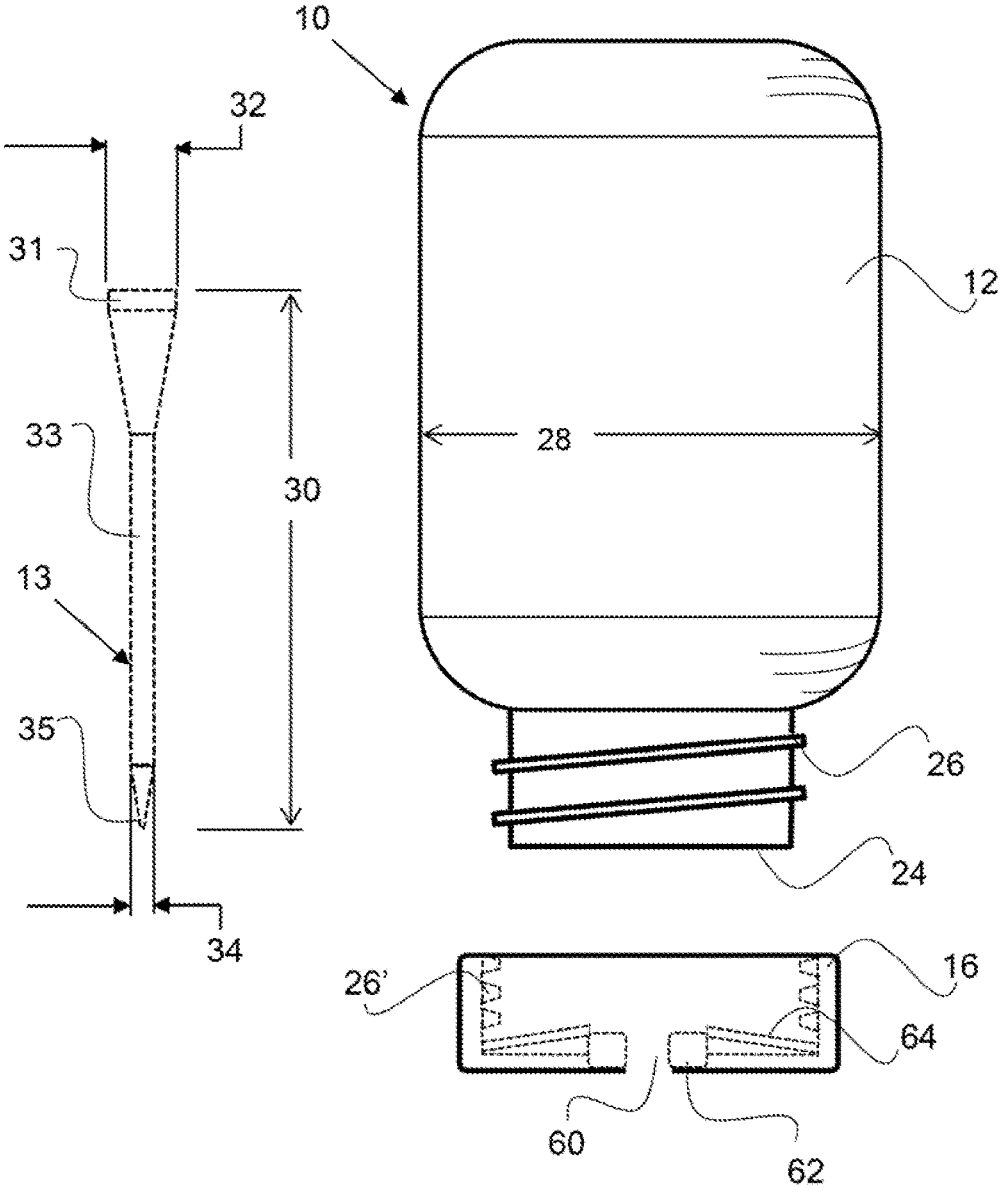

FIG. 5 shows a side view of an exemplary golf tee container and a side cut-away view of a cap detached from the container.

Figure 6:
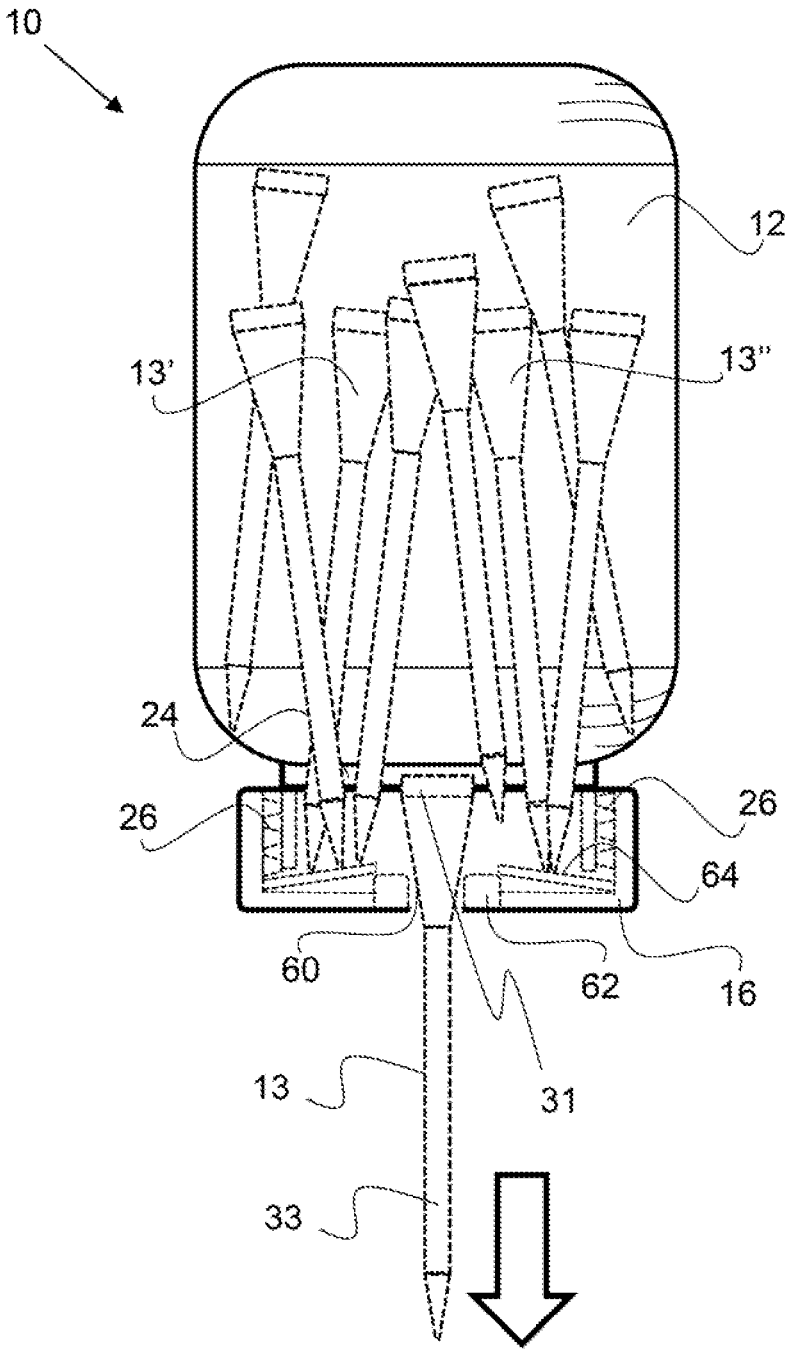

FIG. 6 shows a side cut-away view of an exemplary golf tee dispenser having a tee retained by in the tee-opening by the resilient retainer.

Figure 7:
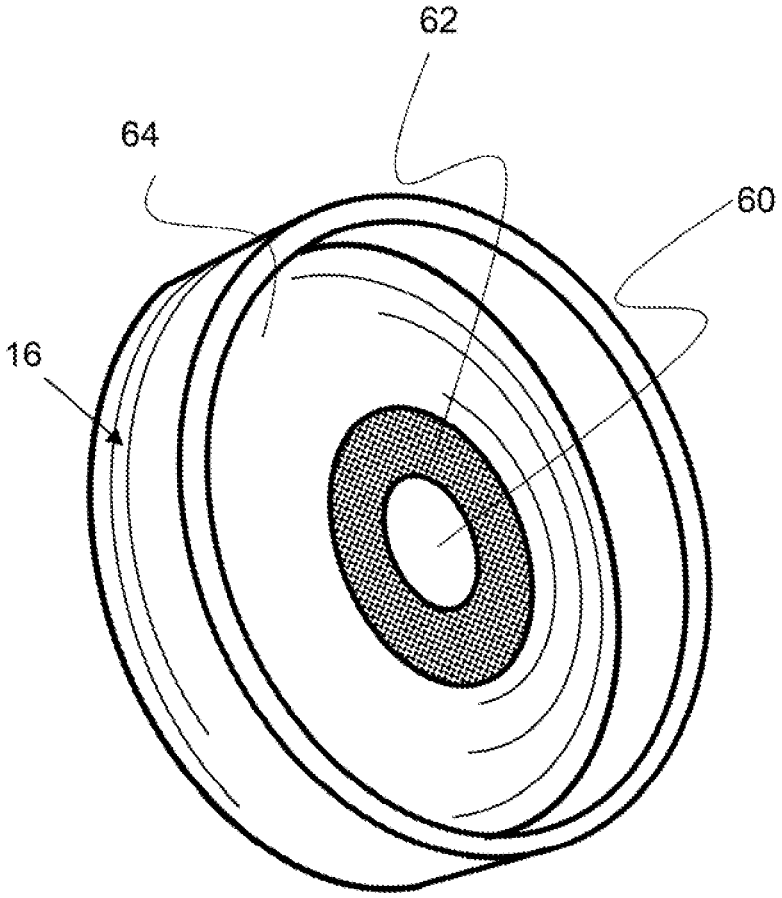

FIG. 7 shows a perspective view of an exemplary cap having a deflector and a retainer configured with a tee-opening.

Figure 8A:
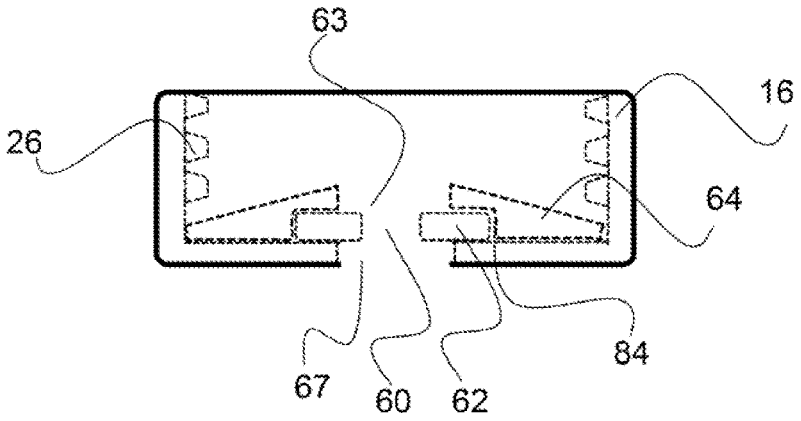

FIG. 8A shows a side cut-away view of an exemplary cap having a detachable deflector and resilient retainer.

Figure 8B:
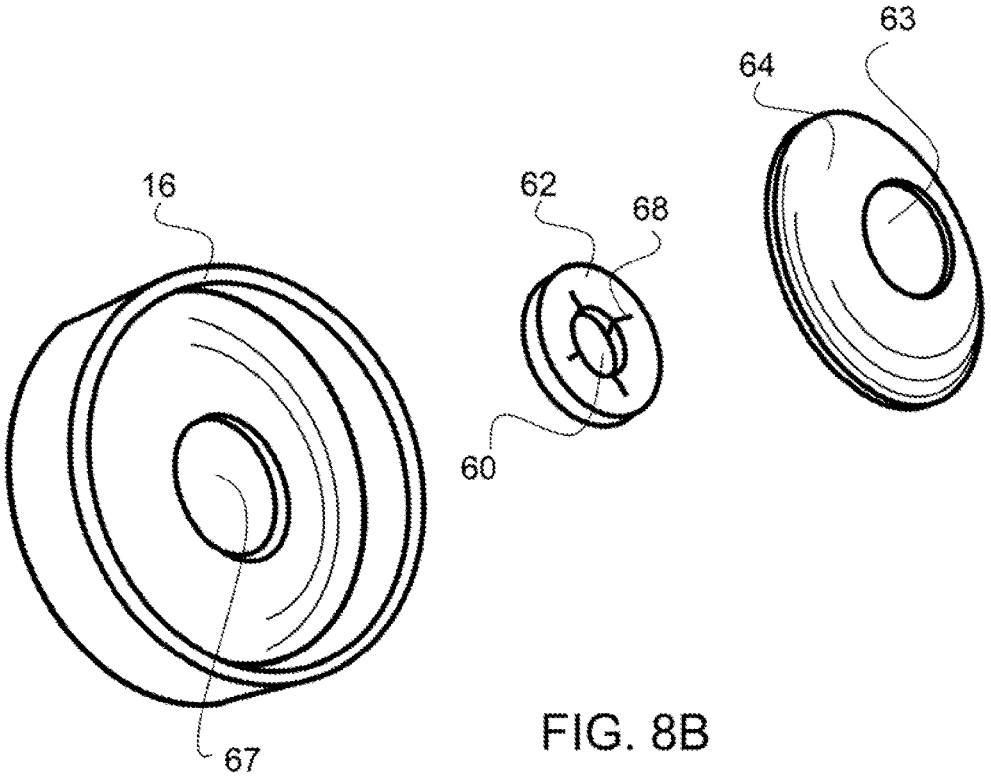

FIG. 8B show a perspective exploded view of an exemplary cap, resilient retainer and deflector.

Figure 9A:
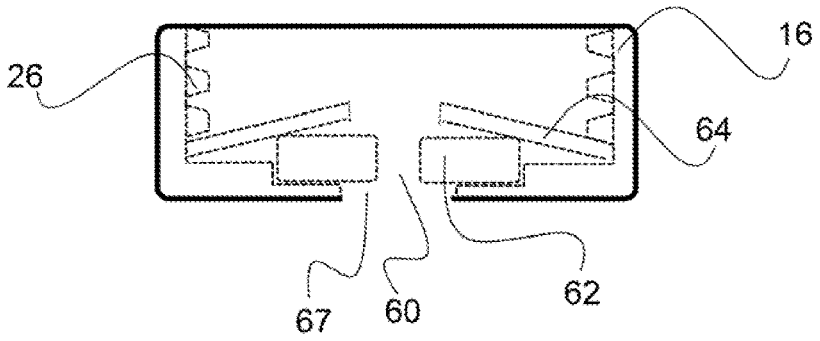

FIG. 9A shows a side cut-away view of an exemplary cap having a detachable deflector and resilient retainer.

Figure 9B:
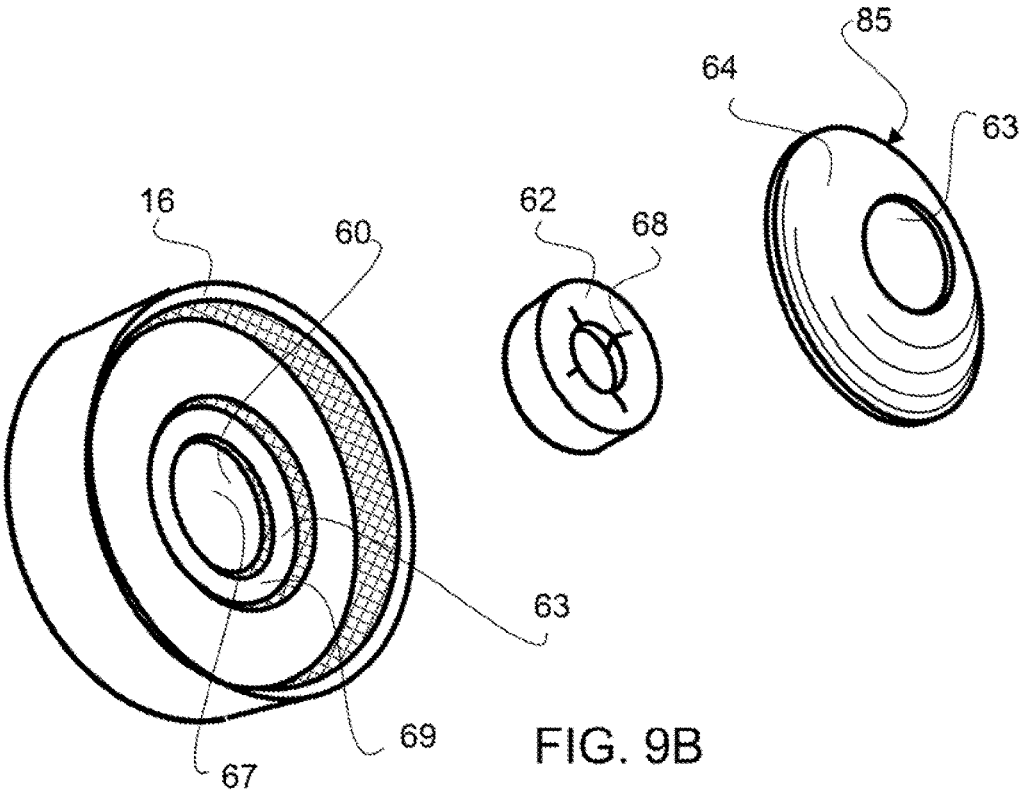

FIG. 9B shows a perspective exploded view of the cap, resilient retainer and deflector.

Figure 10A:
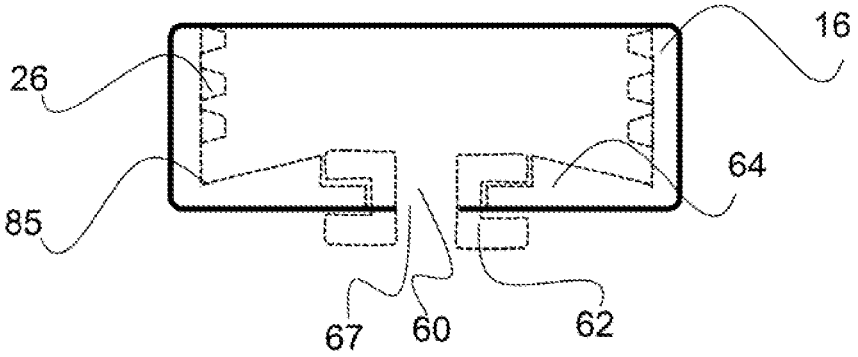

FIG. 10A shows a side cut-away view of an exemplary cap having an integral deflector and a detachable resilient retainer.

Figure 10B:
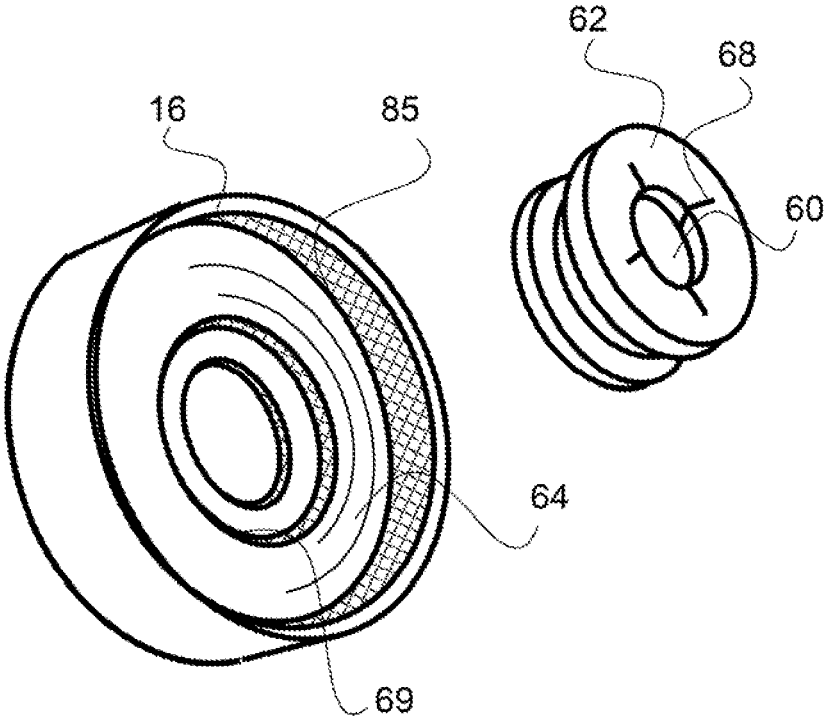

FIG. 10B shows a perspective exploded view of an exemplary cap having an integral deflector and a detachable resilient retainer.

Figure 11:
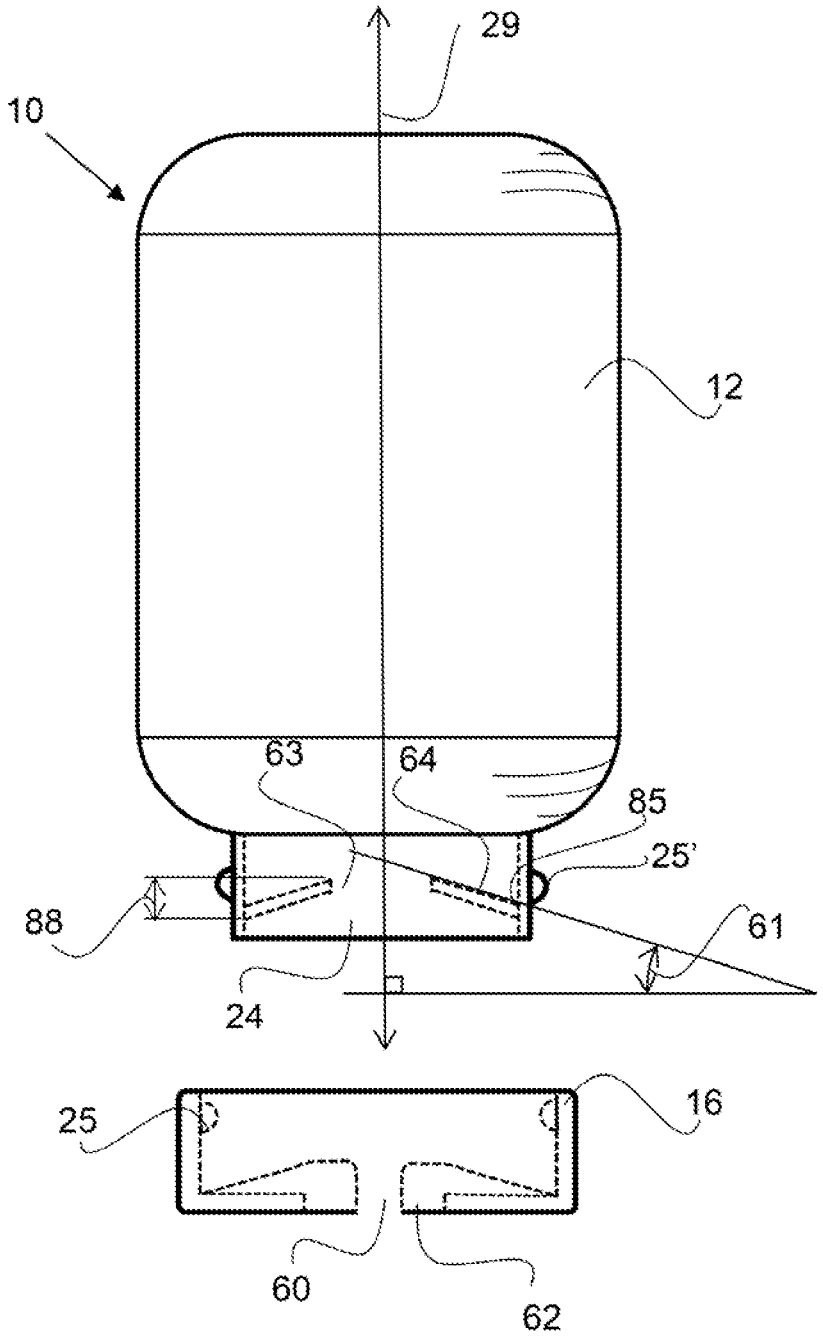

FIG. 11 shows a side cut-away view of an exemplary golf tee dispenser having a deflector attached to the container in the container-opening and a cap having a detachable resilient retainer.

FIGS. 12A through 12E show various exemplary embodiments of resilient retainers having a tee-opening configured therein.

Figure 13:
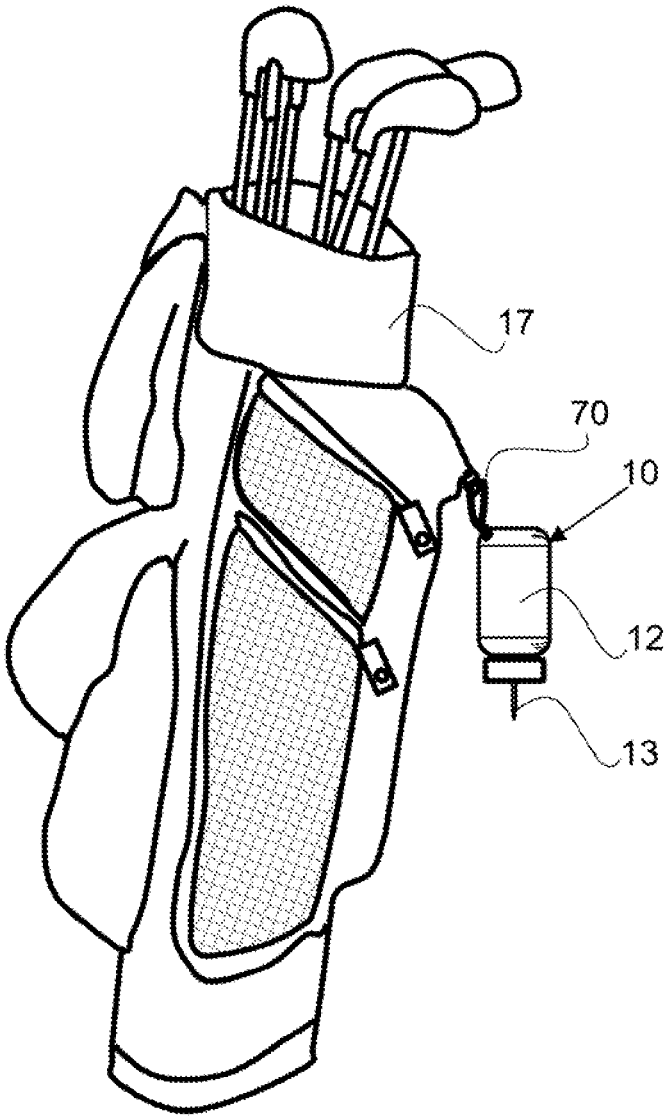

FIG. 13 shows a side perspective view of a golf bag having an exemplary tee dispenser attached thereto.

Figure 14:
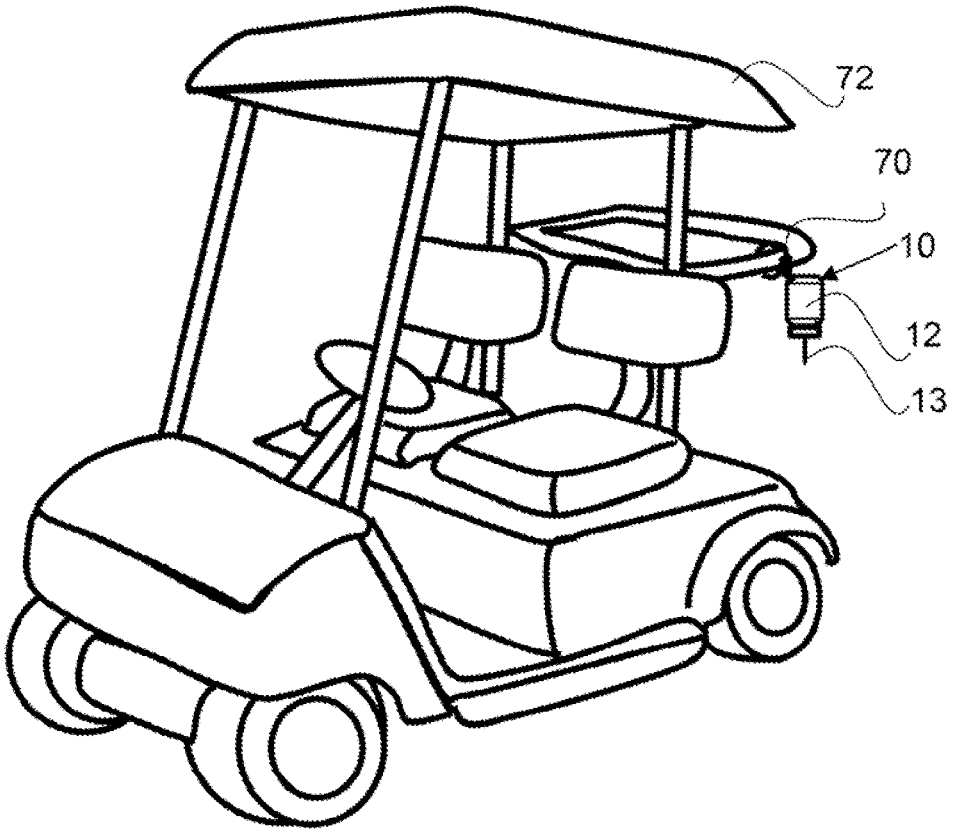

FIG. 14 shows a perspective view of a golf cart having an exemplary tee dispenser attached thereto.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, a golf tee dispenser is not configured with a deflector and the plurality of tees are jammed inward. It has been found that a golf tee dispenser without a deflector does not effectively enable a tee to pass through a tee opening as described herein.

As shown in FIG. 2, an exemplary golf tee dispenser 10 has a container 12 for retaining a plurality of tees, a cap 16 over the container opening 24 and a tee extending 13 from the tee-opening 60. An attachment feature 70 is shown attached to the tee container. The maximum cross-length dimension 28, the length of the container 27, and the length axis 29 of the container are shown in FIG. 2. The tee dispenser cap 16 is configured on the tee dispenser end 80 of the container. The opposing end of the container is the tee-head end 82 and may comprise a detachable lid, or cap for tee replacement, as described herein.

As shown in FIG. 3, an exemplary golf tee dispenser 10 has a translucent container 12 that allows a user to see a plurality of tees retained therein. The exemplary golf tee dispenser comprises a deflector that deflects a plurality of tees away from the tee-opening and therefore more effectively allows a single tee to pass through the tee-opening. The orientation of up and down is shown in FIG. 3.

As shown in FIG. 4, an exemplary golf tee dispenser 10 has a cap 16 attached to a container 12. The cap is shown in a cut-away view to show the configuration of an exemplary deflector 64 and resilient retainer 62. A tee 13 is shown extending partially through the tee-opening 60 with the tee-tip 35 passing through the tee opening. The other two tees 13', 13" are shown being deflected away from the tee opening, thereby allowing the tee 13 to more easily pass therethrough. The cap is attached to the container 12 by threads 26. The cap has threads that interface with threads on the container. The cap may have male or female threads and the container will have the opposite. In addition, a detachable cap 79 is configured on the tee-head end 82 of the container 12 and covers the tee-head end opening 83. The tee-head end cap may allow easy refilling of the container with tees after a number of them have been removed from the container 12 through the tee-dispenser 14. The dispenser end 80 is configured with the tee-dispenser 14. The tee-dispenser in this embodiment is detachably attachable to the container and is configured in the cap 16. A tee dispenser 14 is preferably detachably attachable to the container 12.

As shown in FIG. 5, an exemplary golf tee container 10 comprises a container 12 having threads 26 that are configured for attachment with the cap threads 26'. The cap 16 is shown detached from the container 12. An exemplary tee 13 is shown having a tee-shaft 33, tee-head 31, tee-tip 35 and tee length 30. The maximum cross-length dimension 28 of the container may be configured to be less than the length of the tee. The diameter of the tee-shaft 34 is shown and as described herein, the tee-opening may be configured to be larger than the tee-shaft diameter and smaller than the tee-head diameter 32, or maximum tee-head cross length dimension. In most cases, a tee has a circular shaft cross sectional shape and a circular head, however a tee may be configured with any suitable tee-shaft or tee-head configuration.

As shown in FIG. 6, an exemplary golf tee dispenser 10 has a tee 13 retained by in the tee-opening 60 by the resilient retainer 62. The tee-head 31 is retained by the resilient retainer 62 and the tee-shaft 33 has extended through the tee-opening 60. A golfer may simply pull on the tee-shaft, as indicated by the bold arrow, to deflect the resilient retainer and retrieve the tee from the golf tee dispenser.

As shown in FIG. 7, an exemplary cap 16 has a deflector 64 configured over a resilient retainer 62. The resilient retainer has a tee-opening 60 configured therein. In this embodiment, the deflector is retained when the cap is attached to the container.

As shown in FIG. 8A, an exemplary cap 16 has a detachable deflector 64 and resilient retainer 62. The exemplary deflector 16 has a recessed area 84 for retaining the resilient retainer over the cap-opening. The resilient retainer 62 may have an circular perimeter and the deflector recessed area 84 may be have a circular shape or be a radial recessed area. The deflector-opening 63, the tee-opening 60 and the cap opening 67 are aligned to allow a tee to pass therethrough. The deflector-opening and cap opening 67 are larger in dimension, or diameter in this case, than the tee-opening. This is to allow only the resilient retainer to interface with the tee-head to retain the tee that is extended out from the container for retrieval. A resilient retainer may be attached to a deflector enabling the two components to be placed into a cap together.

As shown in FIG. 8B, an exemplary cap 16, resilient retainer 62 and deflector 64 are separate components. The deflector 64 is cone shaped and has a deflector opening 63. The defector may also be funnel shaped, as shown in FIG. 8B with the small opening of the funnel oriented upward or into the container and the larger opening oriented down or towards the cap. The resilient retainer 62 is disc shaped having a tee-opening 60 and a plurality of slits 68. The cap 16 has a cap opening 67. As shown in FIGS. 8A and 8B, the deflector opening 63 is larger in diameter than the tee-opening in the resilient retainer 62. This larger size of the deflector opening may capture a tee-tip within the inner perimeter of the deflector opening and subsequent agitation may cause this captured tee to extend down through the tee-opening. A deflector opening with a larger diameter than a tee-opening diameter may be preferred for this reason. In addition, the cap opening 67 is larger in diameter than the tee-opening 60 which may enable the resilient retainer to deflect downward as a tee is pull out from the container. For this reason, a cap opening that is larger in diameter than the tee-opening may be preferred.

As shown in FIG. 9A, an exemplary cap 16 has a detachable deflector 64 and resilient retainer 62. The resilient retainer is held in place by a cap-recess 69. The bottom outer perimeter of the resilient retainer is configured to fit within the cap-recess.

As shown in FIG. 9B an exemplary cap 16 is configured with a cap-recess 69 to retain the resilient retainer 62. The deflector 64 is configured to fit over the resilient retainer and may be retained by a container when the cap is attached over a container opening. The deflector has a deflector opening 63 that is raised up from the outer perimeter 85 of the deflector. The deflector is cone shaped having a larger outer perimeter diameter than the diameter of the deflector opening that offset vertically or above the outer perimeter. The upper deflector surface 86 is configured to deflect a portion of the tees within the container away from the tee opening 60. The deflector opening 63, the tee-opening 60 and cap opening 67 are all aligned to allow a tee to be dispensed from the container. The deflector opening 63 is larger in diameter than the tee-opening 60.

As shown in FIG. 10A, an exemplary cap 16 has an integral deflector 64 and a detachable resilient retainer 62. The integral deflector is a one-piece unit with the cap 16. The resilient retainer 62 is configured to attach around a cap-opening 67. The resilient retainer has an enlarged top and bottom portion coupled by a more narrow center portion. The resilient retainer has the general shape of a grommet.

As shown in FIG. 10B, an exemplary cap 16 has an integral deflector 64 and a detachable resilient retainer 62. The resilient retainer has a plurality of slits 68 extending from the tee opening 60 radially outward.

As shown in FIG. 11, an exemplary golf tee dispenser 10 has a deflector 64 attached to the container 12 in the container-opening. The deflector and container are a one-piece unit and are formed out of a single piece of material in this embodiment. The cap 16 has a detachable resilient retainer 62 that has a top profile shape configured to conform with the deflector underside shape, or bottom surface of the defector. The cap also has an attachment feature 25, or protrusion, configured to snap over the attachment feature 25' of the container. It is to be understood that a resilient retainer, as shown in FIG. 11 may not require an additional deflector as the top surface geometry of the resilient retainer may be configured to deflect a plurality of tees to the outside or away from tee-opening. The resilient retainer and deflector may be integral in this case. The deflector 64 is configured at an offset angle 61 from perpendicular to the length axis 29 of the container. The offset angle of the integral deflector is more than fifteen degrees. A deflector may have a height 88 from the bottom opening, or outer perimeter 85, to the deflector opening 63 including, but not limited to, about 0.125 inches or more, about 0.25 inches or more, about 0.375 inches or more, about 0.5 inches or more, about 1.0 inches or more and any range between and including the values provided. A greater height, or offset angle will cause tees to be deflected away from the central opening of the deflector more aggressively.

Figure 12A:
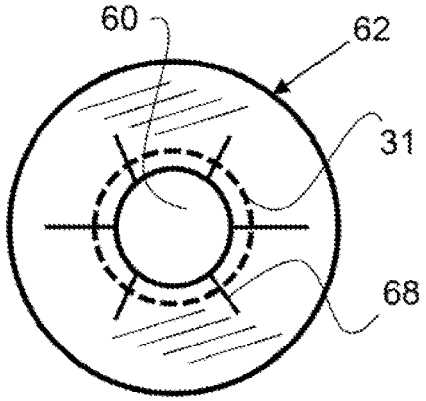
Figure 12B:
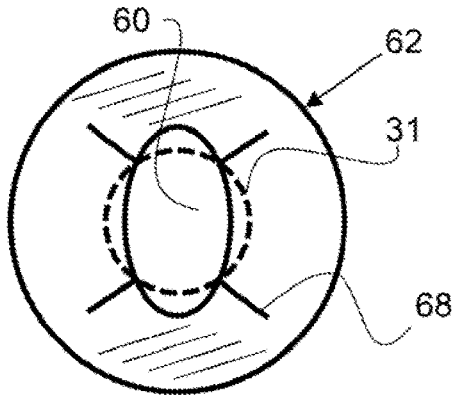
Figure 12C:
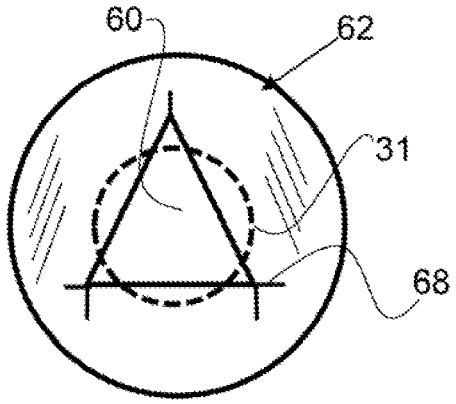
Figure 12D:
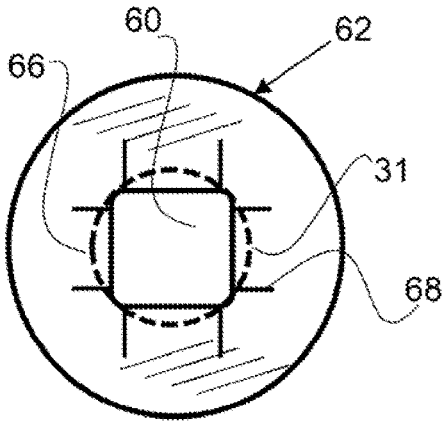
Figure 12E:
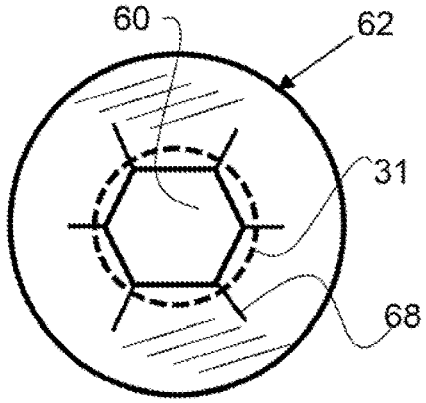

FIGS. 12A through 12E show various exemplary embodiments of resilient retainers 62 having a tee-opening 60 configured therein. FIG. 12A shows a circular shaped tee-opening having a plurality of slits 68 extending from the tee-opening toward the perimeter of the resilient retainer. FIG. 12B shows an oval shaped tee-opening having a plurality of slits 68 extending from the tee-opening toward the perimeter of the resilient retainer. FIG. 12C shows a triangular shaped tee-opening having a plurality of slits 68 extending from the tee-opening toward the perimeter of the resilient retainer. FIG. 12D shows a square shaped tee-opening having a plurality of slits 68 extending from the tee-opening toward the perimeter of the resilient retainer forming flaps 66. FIG. 12E shows a polygonal shaped tee-opening, or hexagon in this case, having a plurality of slits 68 extending from the tee-opening toward the perimeter of the resilient retainer.

As shown in FIG. 13, an exemplary tee dispenser 10 is attached to a golf bag 17. As described herein, a golf tee dispenser may be agitated or shaken during the normal course of carrying a golf bag around the golf course, and this agitation will cause a tee 13 to extend through the tee-opening, as shown.

As shown in FIG. 14, an exemplary tee dispenser 10 is attached to a golf cart 72. The vibration caused by the cart driving around the golf course will cause a tee to extend through the tee-opening, as shown.

Definitions

A container opening, as described herein is an opening that is configured to allow the loading of a plurality of tees into the container and has an open area that is greater than three of more tees.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed:

1. A golf tee dispenser comprising:

a) a container comprising a container opening and configured to hold a plurality of golf tees;

b) a cap configured to detachably attach to said container over said container opening, and comprising a cap-opening;

c) a resilient retainer consisting essentially of a resilient material and comprising a single tee-opening; and wherein the resilient retainer is configured to deflect as a tee is pulled out from the container and substantially return to an original shape after said tee has been pulled through the tee-opening;

d) a deflector configured over the resilient retainer within the container, the deflector comprising:

a deflector-opening;

an outer perimeter; and an upper surface;

wherein the deflector opening is centrally located on the deflector, elevated above the outer perimeter and aligned with the tee opening; and wherein the upper surface of the deflector extends down from the deflector opening to the outer perimeter of the deflector to deflect a portion of said plurality of golf-tees away from said tee-opening and toward the outer perimeter of the deflector to prevent jamming of tees in the tee opening;

whereby, when the container is shaken, a portion of said plurality of tees are deflected away from the tee opening to the outer perimeter of the deflector to prevent jamming of tees in the tee opening;

wherein the tee-opening, the cap-opening and the deflector-opening are all at least partially aligned to allow a tee to pass from an interior of the container out of the container.

2. The golf tee dispenser of claim 1, wherein the container is configured to hold 10 or more golf tees.

3. The golf tee dispenser of claim 1, wherein the container is configured with a single opening that is configured for the attachment of the cap.

4. The golf tee dispenser of claim 1, wherein the container has a length and a cross-length dimension and wherein the cross-length dimension is less than a tee length.

5. The golf tee dispenser of claim 1, wherein the container is translucent.

6. The golf tee dispenser of claim 1, wherein the container comprises threads configured about the container opening and the cap comprises threads for detachably attachment to the container.

7. The golf tee dispenser of claim 1, wherein the tee-opening is larger than a tee-shaft and smaller than a tee-head diameter.

8. The golf tee dispenser of claim 1, wherein the resilient retainer comprises an outside perimeter and at least one slit that extends from the tee-opening toward said outside perimeter.

9. The golf tee dispenser of claim 1, wherein the resilient retainer comprises a an outside perimeter and a plurality of slits that extend from the tee-opening toward said outside perimeter to form a plurality of flaps, wherein the flaps are configured to deflect to allow a tee to be pulled from the container and then substantially return to an original shape after said tee has been pulled through the tee-opening.

10. The golf tee dispenser of claim 1, wherein the resilient retainer comprises an elastomeric material.

11. The golf tee dispenser of claim 1, wherein the resilient retainer is detachably attachable to the cap.

12. The golf tee dispenser of claim 1, wherein the resilient retainer is at least partially configured within a recess in the cap.

13. The golf tee dispenser of claim 1, wherein the resilient retainer comprises a first and a second enlarged portion connected by a more narrow center portion, wherein the resilient retainer is configured to detachably attach to the cap with said center portion aligned within the cap opening and the first enlarged portion within the cap and the second enlarged portion outside of the cap.

14. The golf tee dispenser of claim 1, wherein the deflector is cone shaped having an outer perimeter diameter that is larger than a deflector opening diameter.

15. The golf tee dispenser of claim 1, wherein the upper surface of the deflector has an offset angle from perpendicular to a length axis of the container of at least fifteen degrees.

16. The golf tee dispenser of claim 1, wherein the deflector is an integral deflector, wherein the deflector and cap are a one-piece unit.

17. The golf tee dispenser of claim 1, wherein the deflector is an integral deflector, wherein the deflector and container are a one-piece unit.

18. The golf tee dispenser of claim 1, wherein the deflector is detachably attachable to the golf tee dispenser and a separate component from the resilient retainer.

19. The golf tee dispenser of claim 1, wherein the deflector opening in larger in diameter than a tee-opening.

20. A golf tee dispenser comprising:

a) a container configured to hold at least ten golf tees and comprising a single container opening;

b) a cap configured to detachably attach to said container over said container opening, and comprising a cap-opening;

c) a resilient retainer consisting essentially of a resilient material and comprising a tee-opening wherein the resilient retainer is configured to deflect as a tee is pulled out from the container and substantially return to an original shape after said tee has been pulled through the tee-opening; and a. a cone-shaped deflector comprising:

a deflector-opening;

an outer perimeter; and an upper surface having an offset angle of at least fifteen degrees;

wherein the deflector opening is centrally located on the deflector, elevated above the outer perimeter and aligned with the tee opening; and wherein the upper surface of the deflector extends down from the deflector opening to the outer perimeter of the deflector to deflect a portion of said plurality of golf-tees away from said tee-opening and toward the outer perimeter of the deflector to prevent jamming of tees in the tee opening;

whereby, when the container is shaken, a portion of said plurality of tees are deflected away from the tee opening to the outer perimeter of the deflector to prevent jamming of tees in the tee opening;

wherein the tee-opening, the cap-opening and the deflector-opening are all at least partially aligned to allow a tee to pass from an interior of the container out of the container;

wherein the resilient retainer is detachably attachable to the cap; and wherein the deflector is detachably attachable to the golf tee dispenser.

* * * * *